US011559082B2

(12) United States Patent
Chen et al.

(10) Patent No.: US 11,559,082 B2
(45) Date of Patent: Jan. 24, 2023

(54) RELEASING MECHANISM, AEROSOL GENERATING DEVICE, RELEASING METHOD, AND SMOKE PRODUCING ARTICLE

(71) Applicants: SHANGHAI NEW TOBACCO PRODUCT RESEARCH INSTITUTE CO., LTD, Shanghai (CN); SHANGHAI TOBACCO GROUP CO., LTD, Shanghai (CN)

(72) Inventors: Chaoying Chen, Shanghai (CN); Wenjie Lu, Shanghai (CN); Xianglin Li, Shanghai (CN); Jianghong Qu, Shanghai (CN); Bin Nie, Shanghai (CN)

(73) Assignees: SHANGHAI NEW TOBACCO PRODUCT RESEARCH INSTITUTE CO., LTD, Shanghai (CN); SHANGHAI TOBACCO GROUP CO., LTD, Shanghai (CN)

( * ) Notice: Subject to any disclaimer, the term of this patent is extended or adjusted under 35 U.S.C. 154(b) by 478 days.

(21) Appl. No.: 16/652,965

(22) PCT Filed: Mar. 1, 2018

(86) PCT No.: PCT/CN2018/077765
§ 371 (c)(1),
(2) Date: Apr. 1, 2020

(87) PCT Pub. No.: WO2019/140749
PCT Pub. Date: Jul. 25, 2019

(65) Prior Publication Data

US 2020/0323270 A1 Oct. 15, 2020

(30) Foreign Application Priority Data

Jan. 22, 2018 (CN) ..... 201810060869.3

(51) Int. Cl.

| | |
|---|---|
| ***A24F 40/40*** | (2020.01) |
| ***A24F 40/20*** | (2020.01) |
| ***A24F 40/46*** | (2020.01) |
| ***A24F 40/51*** | (2020.01) |
| ***A24D 1/20*** | (2020.01) |

(52) U.S. Cl.
CPC ..... *A24F 40/40* (2020.01); *A24D 1/20* (2020.01); *A24F 40/46* (2020.01); *A24F 40/51* (2020.01); *A24F 40/20* (2020.01)

(58) Field of Classification Search
CPC ..... A24F 40/46; A24F 40/40; A24F 40/20; A24F 40/51
See application file for complete search history.

(56) References Cited

U.S. PATENT DOCUMENTS

2014/0305449 A1* 10/2014 Plojoux ..... A24F 40/46 131/328
2015/0013696 A1* 1/2015 Plojoux ..... A24F 40/40 131/328

FOREIGN PATENT DOCUMENTS

CN 101487101 A 7/2009
CN 101634001 A 1/2010
(Continued)

OTHER PUBLICATIONS

Korean Patent Office, Result of Examination, Application No. 10-2020-7008029, dated Dec. 15, 2021, in 13 pages.
(Continued)

*Primary Examiner* — Hae Moon Hyeon
(74) *Attorney, Agent, or Firm* — Procopio, Cory, Hargreaves & Savitch LLP

(57) ABSTRACT

The present invention relates to a releasing mechanism, an aerosol generating device, a releasing method, and a smoking producing article. The releasing mechanism comprises: a rotary portion connected to the aerosol generating device rotatably between a first position and a second position, an
(Continued)

aerosol-forming substrate and a heating body are relatively movable in a circumferential direction during switching from the first position to the second position; both in the first position and in the second position, the aerosol-forming substrate is in contact with the heating body. By using the releasing mechanism of the present invention, a user is allowed to easily pull out the aerosol-forming substrate from the heating body, and it is convenient to use and also facilitates cleaning of the aerosol generating device by a user.

30 Claims, 6 Drawing Sheets

(56) References Cited

FOREIGN PATENT DOCUMENTS

| | | | | | |
|---|---|---|---|---|---|
| CN | 101641125 | A | | 2/2010 | |
| CN | 103974640 | A | | 8/2014 | |
| CN | 104451427 | A | | 3/2015 | |
| CN | 106376975 | A | | 2/2017 | |
| EP | 3179828 | A1 | | 6/2017 | |
| FR | 940447 | A | | 12/1948 | |
| KR | 10-2009-0109581 | A | | 10/2009 | |
| KR | 10-2014-0116056 | A | | 10/2014 | |
| WO | 2015/155289 | A1 | | 10/2015 | |
| WO | WO-2015155289 | A1 | * | 10/2015 | ..... A24F 47/008 |
| WO | WO-2021037822 | A1 | * | 3/2021 | ..... A24F 40/20 |
| WO | WO-2021152035 | A1 | * | 8/2021 | |

OTHER PUBLICATIONS

European Patent Office, Extended European Search Report, Application No. EP 18901048.1-1004 / 3744192; dated Sep. 27, 2021 in 9 pages.

International Search Report and Written Opinion for related PCT App No. PCT/CN2018/077765 dated Oct. 29, 2018, 13 pgs.

* cited by examiner

RELEASING MECHANISM, AEROSOL GENERATING DEVICE, RELEASING METHOD, AND SMOKE PRODUCING ARTICLE

CROSS-REFERENCE TO RELATED APPLICATIONS

This application is a U.S. National Stage entry of PCT Application No: PCT/CN2018/077765 filed on Mar. 1, 2018, which claims priority to Chinese Patent Application No. 201810060869.3, filed Jan. 22, 2018, the contents of which are incorporated herein by reference.

TECHNICAL FIELD

The present invention relates to a technical field of aerosol generation, and in particular to a releasing mechanism, an aerosol generating device, a releasing method and a smoking producing article.

BACKGROUND ART

In recent years, an impact of traditional cigarettes on health and environment has gradually attracted attentions of countries around the world. Tobacco producers are committed to providing consumers with less harmful tobacco products. Low-temperature heating and non-burning tobacco products as a new form of tobacco consumer good have gradually been welcomed by the market and are increasingly accepted by cigarette consumers in most countries.

For example, Chinese Patent Publication No. CN106376975A provides an aerosol generating device and a method of using the same. The aerosol generating device comprises: a cavity having a cavity case and a cavity accommodating space formed by the cavity case, wherein the cavity accommodating space is used for accommodating a medium to be heated, and a top of the cavity is provided with filter cotton; a sealing cover disposed at a bottom of the cavity to seal at the bottom of the cavity, wherein a bottom of the sealing cover is formed with a penetrated part; an air deflector disposed below the sealing cover and having a guiding groove and a guiding hole, wherein the guiding hole is disposed correspondingly to the penetrated part; and a heater including a heater bottom cover and a heating ceramic sheet, wherein the heater bottom cover is disposed below the air deflector, and the heating ceramic sheet is fixed to the heater bottom cover, passes through the guiding hole, and pierces the penetrated part to penetrate into the cavity accommodating space.

Chinese Patent Publication No. CN103974640A provides an aerosol generating device configured to receive an aerosol-forming substrate and configured to heat the aerosol-forming substrate using both an internal heater positioned within the substrate, and an external heater positioned outside of the substrate. The use of both the internal heater and the external heater allows each heater to operate at a lower temperature than it may be required when using either the internal heater or the external heater alone. By operating the external heater at a lower temperature than the internal heater, the substrate can be heated to have a relatively uniform temperature distribution while the external temperature of the device can be kept to an acceptably low level.

Existing aerosol generating device generally heats an aerosol-forming substrate by a heater to generate aerosol which is to be suctioned by a user. The aerosol-forming substrate will stick to the heater when the user pulls out the aerosol-forming substrate after completing suctioning. Thus, the aerosol-forming substrate is difficult to be pulled out from the aerosol generating device, which is inconvenient to use and affects experience feeling in use of consumers.

SUMMARY OF THE INVENTION

In order to solve the above problems, an object of the present invention is to provide a releasing mechanism for an aerosol generating device provided with a heating body inserted into an aerosol-forming substrate placed on the releasing mechanism, wherein the releasing mechanism comprises: a rotary portion connected to the aerosol generating device rotatably between a first position and a second position, wherein the aerosol-forming substrate and the heating body are relatively movable in a circumferential direction during switching from the first position to the second position;

wherein both in the first position and in the second position, the aerosol-forming substrate is in contact with the heating body.

Further, the aerosol-forming substrate has a first axial position with respect to the heating body in the first position; the aerosol-forming substrate has a second axial position with respect to the heating body in the second position, and the first axial position is the same as the second axial position.

Further, the aerosol-forming substrate is rotatable to the second position along the circumferential direction in synchronization with the rotary portion.

Further, the aerosol-forming substrate is subjected to a radial pressing force in the second position.

Further, a pressing mechanism for applying a radial pressing force to the aerosol-forming substrate is disposed on the rotary portion.

Further, the pressing mechanism is a pressing elastic piece disposed to face the aerosol-forming substrate.

Further, the pressing elastic piece is disposed around the aerosol-forming substrate, and an outer surface of the rotary portion at least partially comprises the pressing elastic piece.

Further, at least one first through-hole communicating with the rotary portion is disposed on the rotary portion; wherein the pressing mechanism is connected to the rotary portion, and one end of the pressing mechanism is inserted into the first through-hole along a radial direction to apply the radial pressing force to the aerosol-forming substrate.

Further, the pressing mechanism extends along an axial direction, which coincides with an inserting direction of the heating body.

Further, it further comprises a first case, which is sleeved on the rotary portion and is movable along the axial direction to press the pressing mechanism into the first through-hole.

Further, the rotary portion comprises an abutting surface, wherein a portion between one end and other end of the pressing mechanism is abutted against the abutting surface, and the other end of the pressing mechanism is connected to the rotary portion by an elastic element.

Further, the elastic element is sleeved on an outer surface of the rotary portion and clamps the other end of the pressing mechanism.

Further, the pressing mechanism is a plurality of pressing mechanisms spaced apart along the circumferential direction.

Further, the pressing mechanism has a first convex portion extending along the radial direction, and the first convex portion is abutted against an inner wall of the first case along the axial direction.

Further, the abutting surface is provided with a second convex portion, and the portion between the one end and the other end of the pressing mechanism is provided with a first concave portion against which the second convex portion is abutted; or alternatively the abutting surface is provided with a first concave portion, and the portion between the one end and the other end of the pressing mechanism is provided with a second convex portion which is abutted against the first concave portion.

Further, at least one convex portion for applying a radial pressing force to the aerosol-forming substrate is disposed on a wall of the rotary portion.

Further, the convex portion is an elastic piece.

Further, the elastic piece extends along an axial direction.

Further, the elastic piece has a first end and a second end which are respectively connected to the wall of the rotary portion, a portion between the first end and the second end is radially protruded outward along a direction from the first end to the second end, and a surface area of a top of the portion radially protruded outward is smaller than each of a surface area of the first end and a surface area of the second end.

Further, it further comprises a first case which is sleeved on the rotary portion and is movable along an axial direction, which coincides with an inserting direction of the heating body, to drive the rotary portion to rotate along the circumferential direction.

Further, an outer surface of the rotary portion is provided with at least one spiral groove extending along the axial direction, and at least one third convex portion is disposed within a case wall of the first case; or alternatively the outer surface of the rotary portion is provided with at least one third convex portion, and an inner surface of the case wall of the first case is provided with the at least one spiral groove extending along the axial direction; the third convex portion is disposed in the spiral groove and is slidable within the spiral groove.

Further, the third convex portion is a plurality of third convex portions spaced apart along the same circumferential direction.

Further, a portion of the rotary portion adjacent to the heating body is provided with at least one second through-hole communicating with the rotary portion, and the aerosol-forming substrate is exposed by the second through-hole.

Further, a pressing mechanism for applying a radial pressing force to the aerosol-forming substrate along the radial direction is disposed at the second through-hole.

Further, an outer surface of the rotary portion is provided with a gear extending along the circumferential direction, and a power source is disposed on the releasing mechanism for driving the gear to rotate along the circumferential direction.

Further, the movement of the aerosol-forming substrate in the circumferential direction is restricted after the aerosol-forming substrate is placed on the rotary portion along an axial direction which coincides with an extending direction of the heating body.

Further, an inner wall of the rotary portion is provided with at least one second concave portion, an outer surface of the aerosol-forming substrate is provided with at least one fourth convex portion, and the fourth convex portion is inserted into the second concave portion along the axial direction; or alternatively the inner wall of the rotary portion is provided with at least one fourth convex portion, the outer surface of the aerosol-forming substrate is provided with at least one second concave portion, and the fourth convex portion is inserted into the second concave portion along the axial direction.

Further, the second concave portion extends along the axial direction, and the fourth convex portion extends along the axial direction.

Further, the aerosol-forming substrate is subjected to a radial pressing force while the rotary portion is switched from the first position to the second position.

Further, the elastic piece is provided with a deformation sensor for detecting whether the aerosol-forming substrate is placed on the rotary portion according to a deformation of the elastic piece.

Further, the rotary portion is provided with a hole through which the heating body is inserted, and the hole has an aperture which is not smaller than an outer diameter of the heating body.

Further, the rotary portion is a cavity.

The present invention also provides an aerosol generating device, comprising: a heating body; and the releasing mechanism of any one of those above.

Further, it further comprises a body portion on which the heating body is disposed, and the rotary portion is disposed on the body portion, connected to the body portion rotatably in the circumferential direction, and has no relative movement in the axial direction with respect the body portion.

Further, it further comprises a body portion on which the heating body is disposed, and the rotary portion is disposed on the body portion, connected to the heating body rotatably in the circumferential direction, and has no relative movement in the axial direction with respect to the heating body.

The present invention also provides a method of releasing an aerosol-forming substrate, comprising: causing the aerosol-forming substrate being rotatable from a first position to a second position along a circumferential direction with respect to a heating body of an aerosol generating device after the heating body is inserted into the aerosol-forming substrate, wherein the aerosol-forming substrate and the heating body are relatively movable in a circumferential direction during switching from the first position to the second position;

wherein both in the first position and in the second position, the aerosol-forming substrate is in contact with the heating body.

Further, the aerosol-forming substrate has a first axial position with respect to the heating body in the first position; the aerosol-forming substrate has a second axial position with respect to the heating body in the second position, and the first axial position is the same as the second axial position.

Further, the aerosol-forming substrate is rotatable to the second position along the circumferential direction in synchronization with the rotary portion of the releasing mechanism of any one of those above.

Further, the aerosol-forming substrate is subjected to a radial pressing force in the second position.

Further, the aerosol-forming substrate is subjected to a radial pressing force while the rotary portion of the releasing mechanism of any one of those above is switched from the first position to the second position.

The present invention also provides a smoking producing article comprising an aerosol-forming substrate which is usable to the above releasing mechanism, and wherein an outer surface of the aerosol-forming substrate is provided with a fourth convex portion or a second concave portion.

As described above, the present invention provides a releasing mechanism for an aerosol generating device provided with a heating body inserted into an aerosol-forming substrate placed on the releasing mechanism. The releasing mechanism comprises a rotary portion on which the aerosol-forming substrate is placed. The rotary portion is connected to the aerosol generating device rotatably between a first position and a second position. The aerosol-forming substrate and the heating body are relatively movable in a circumferential direction during switching from the first position to the second position.

When a user is suctioning, the aerosol-forming substrate is placed on the rotary portion, and the heating body is inserted into the aerosol-forming substrate. At this time, the rotary portion is in the first position, the aerosol-forming substrate is in contact with the heating body, and the heating body is controlled to heat the aerosol-forming substrate to generate an aerosol for the user to suction. When the user completes suctioning, the rotary portion is controlled to be rotationally switched from the first position to the second position along the circumferential direction with respect to the aerosol generating device before the aerosol-forming substrate is pulled out. At this time, the aerosol-forming substrate is in contact with the heating body, and the aerosol-forming substrate and the heating body are relatively moved in the circumferential direction.

The aerosol-forming substrate being adhered to the heating body is released from the heating body during the relative movement in circumferential direction between the aerosol-forming substrate and the heating body. The aerosol-forming substrate can be easily pulled out from the heating body by the user, and it is convenient to use and also convenient for the user to clean the aerosol generating device. Meanwhile, since the heating body and the aerosol-forming substrate are relatively moved in the circumferential direction and have no relatively movement in the axial direction, the heating body has no movement in the axial direction during pulling out the aerosol-forming substrate, such that the stability of the connection between the heating body and the aerosol generating device is maintained and the life of the heating body is extended.

In order to make the above contents of the present invention more comprehensible, preferred embodiments are described in detail below with reference to accompanying drawings.

DETAILED DESCRIPTION

The embodiments of the present invention are described below by way of specific examples, and those skilled in the art can readily understand other advantages and functions of the present invention from the disclosure of the present specification. Although the description of the present invention will be described in conjunction with the preferred embodiments, the present invention is not limited thereto. Rather, the present invention is described in conjunction with the embodiments so as to cover other possible alternatives or modifications developed based on claims of the present invention. In order to provide a thorough understanding of the present invention, many specific details are included in the following description. In addition, some of specific details are omitted in the description in order to avoid confusing or obscuring key points of the present invention.

First Embodiment

Figure 1:
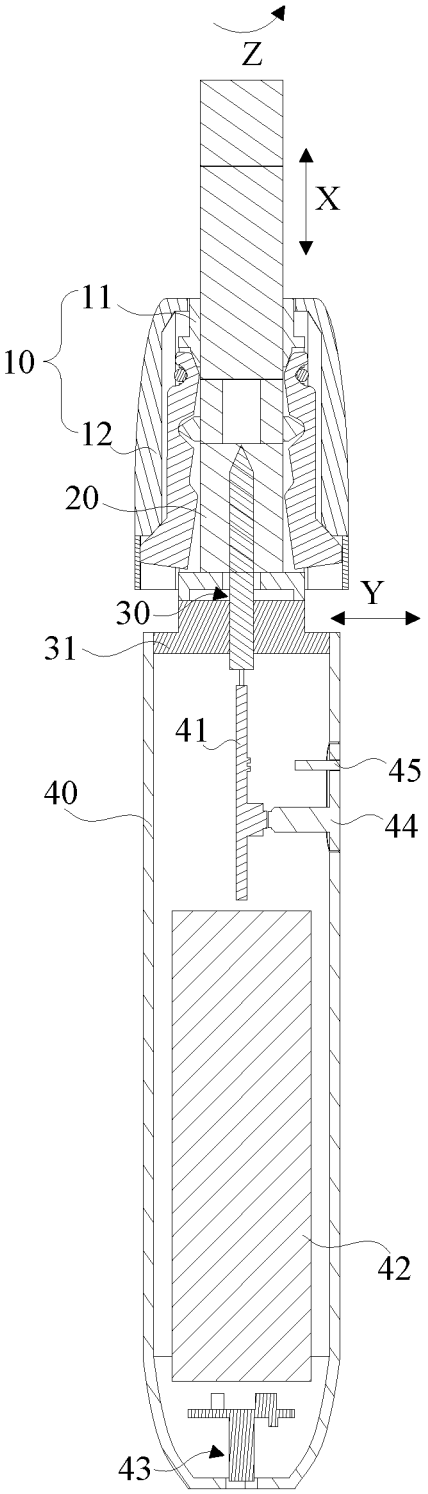
FIG. 1 is a sectional view of a releasing mechanism mounted on an aerosol generating device of an embodiment of present invention.
Figure 2:
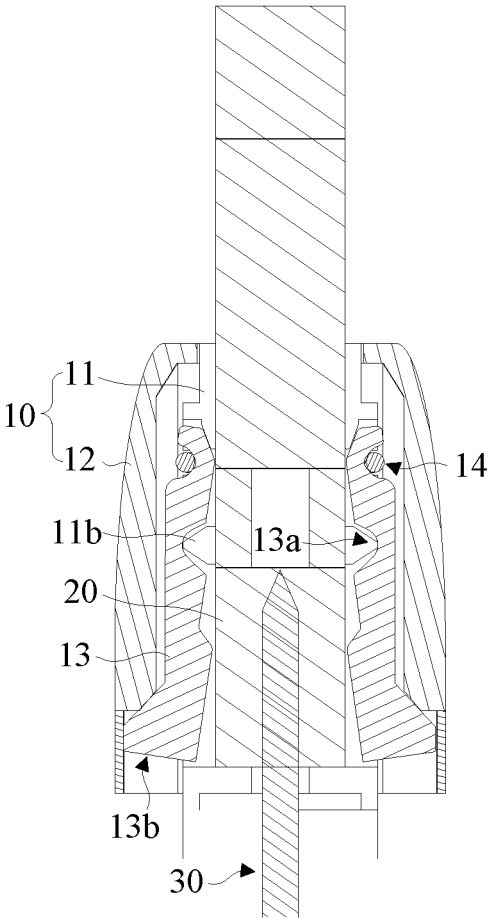
FIG. 2 is an enlarged view of a releasing mechanism of an embodiment of present invention.
Figure 3:
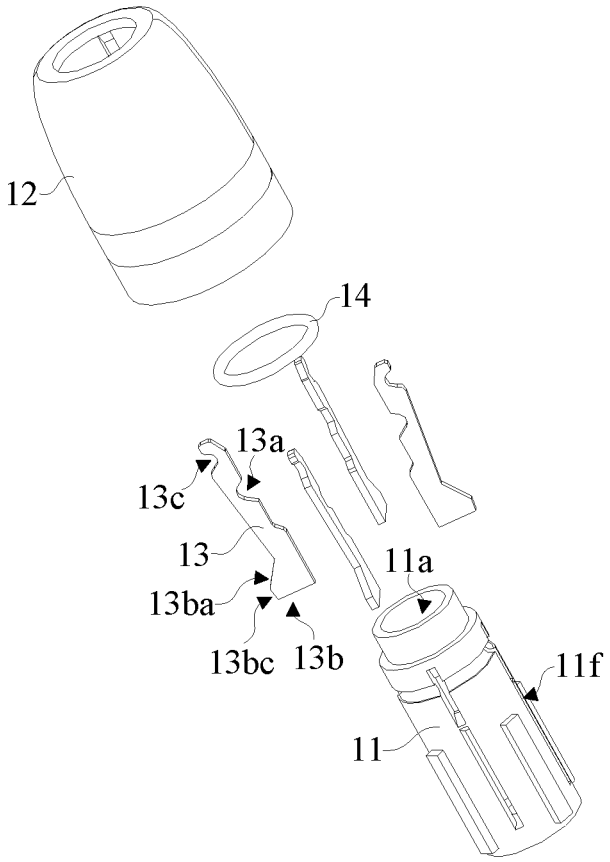
FIG. 3 is a first exploded perspective view of a releasing mechanism of an embodiment of present invention.

Referring to FIGS. 1 to 3, the present invention provides a releasing mechanism 10 for producing an aerosol generating device which is provided with a heating body 30. The heating body 30 is inserted into an aerosol-forming substrate 20 placed on the releasing mechanism. The releasing mechanism comprises a rotary portion 11 on which the aerosol-forming substrate 20 is placed. A specific shape of the rotary portion 11 is not limited as long as the aerosol-forming substrate 20 can be placed thereon. In this embodiment, the rotary portion 11 is a cavity, and the rotary portion 11 has a cylindrical shape as a whole, and has an accommodating chamber 11*a*. In other embodiments, it may be of other shapes, for example, it has a disk body on which two clamping portions are convexly formed, and the aerosol-forming substrate is clamped by the clamping portions, so that the aerosol-forming substrate can also be placed on the rotary portion.

A specific material of the rotary portion 11 is not limited, and for example, the rotary portion 11 can be formed from a high temperature resistant material such as metal, ceramic or high molecular material. The rotary portion 11 of the present invention is rotatably connected to the aerosol generating device between a first position and a second position. The aerosol-forming substrate 20 and the heating body 30 of the present invention are relatively moved in a circumferential direction (shown in a Z direction in FIG. 1) during switching from the first position to the second position.

When a user is suctioning, the aerosol-forming substrate 20 is placed in the accommodating chamber 11*a* of the rotary portion 11, and the heating body 30 is inserted into the aerosol-forming substrate 20. When the rotary portion 11 is in the first position, the aerosol-forming substrate 20 is in contact with the heating body 30. The aerosol-forming substrate 20 has a first axial position with respect to the heating body 30, and the heating body 30 is controlled to heat the aerosol-forming substrate 20 to generate an aerosol for the user to suction.

When the user completes suctioning, the rotary portion 11 is controlled to be rotationally switched from the first position to the second position along the circumferential direction (shown in the Z direction in FIG. 1) with respect to the aerosol generating device before the aerosol-forming substrate 20 is pulled out. The rotary portion 11 can perform a clockwise rotation, perform a counterclockwise rotation, or perform the clockwise rotation and the counterclockwise rotation alternately along the circumferential direction. During switching of the rotary portion 11 from the first position to the second position, the aerosol-forming substrate 20 is in contact with and in connection with the heating body 30, and the aerosol-forming substrate 20 and the heating body 30 are relatively movable in the circumferential direction (shown in the Z direction in FIG. 1). In the second position, the aerosol-forming substrate 20 has a second axial position with respect to the heating body 30. The first axial position is the same as the second axial position. Preferably, the aerosol-forming substrate and the heating body have no relative movement in an axial direction during switching from the first position to the second position.

That is, both in the first position and in the second position, the aerosol-forming substrate 20 is in contact with the heating body 30 and there is no relative movement in the axial direction. The aerosol-forming substrate 20 being adhered to the heating body 30 is released from the heating body 30 during the relative movement in circumferential direction between the aerosol-forming substrate 20 and the heating body 30. The aerosol-forming substrate 20 can be easily pulled out from the heating body 30 by the user, and it is convenient to use and also convenient for the user to clean the aerosol generating device.

Meanwhile, since the heating body 30 and the aerosol-forming substrate 20 are relatively moved in the circumferential direction and have no relatively movement in the axial direction, the rotary portion 11 can be prevented from applying an axial force to the heating body 30 during the rotation and thus it is advantageous for stabilizing the connection of the heating body 30 with the aerosol generating device and extending the life of the heating body 30.

Further, since the heating body 30 and the aerosol-forming substrate 20 are relatively moved in the circumferential direction and have no relative movement in the axial direction, a high temperature part of the heating body 30 (a tip end part of the heating body 30) can be prevented from coming into contact with the releasing mechanism, so that aging of the releasing mechanism is delayed, and the life of the releasing mechanism is extended.

It should be noted that, in the embodiment of the present invention, the aerosol-forming substrate 20 has the first axial position with respect to the heating body 30 in the first position; the aerosol-forming substrate 20 has the second axial position with respect to the heating body 30 in the second position, and the first axial position is the same as the second axial position. That is, both in the first position and in the second position, the aerosol-forming substrate 20 is in contact with the heating body 30 and there is no relative movement in the axial direction. In other embodiment, the first axial position may not be the same as the second axial position, and during rotation of the rotary portion 11 with respect to the aerosol generating device, the aerosol-forming substrate 20 is in contact with the heating body 30, and the heating body 30 and the aerosol-forming substrate 20 are not only moved in the circumferential direction but also moved in the axial direction; as long as the aerosol-forming substrate 20 and the heating body 30 are relatively movable in the circumferential direction and the aerosol-forming substrate 20 is in contact with the heating body 30 during switching from the first position to the second position.

In addition, in this embodiment, during switching of the rotary portion 11 from the first position to the second position, the rotary portion 11 rotates along the circumferential direction, and the heating body 30 remains stationary; in other embodiments, the heating body may rotate along the circumferential direction, and the rotary portion 11 may remain stationary, as long as in the second position, the aerosol-forming substrate 20 and the heating body 30 are relatively moved in the circumferential direction. When the heating body is rotated along the circumferential direction, the heating body may be rotated synchronously with the aerosol generating device at which the heating body is located, or alternatively, the heating body also may be rotated while the aerosol generating device at which the heating body is located may remain stationary.

Additionally, a specific type of the aerosol-forming substrate 20 of the present invention is not limited, as long as it can generate an aerosol for the user to suction after being heated by the heating body 30. The aerosol-forming substrate 20 can be heated but not burned during the heating body 30 heating the aerosol-forming substrate 20. For example, in this embodiment, the aerosol-forming substrate 20 is a solid aerosol-forming substrate containing a tobacco component, and the aerosol-forming substrate 20 is wrapped by an outer package (for example, an aluminum foil layer).

In addition, a specific shape of the heating body 30 is not limited. In this embodiment, the heating body 30 has a columnar shape with a circular cross section. In other embodiments, the heating body 30 may have a quadrilateral, triangular or polygonal cross section. As the number of sides of the cross section of the heating body 30 increases, the aerosol-forming substrate 20 is more easily released from the heating body 30 during the relative movement in circumferential direction between the heating body 30 and the aerosol-forming substrate 20. When the aerosol-forming substrate 20 is pulled out from the heating body 30, the amount of the aerosol-forming substrate 20 remaining on the heating body 30 is less, which is more advantageous for the user to clean the aerosol generating device.

A specific material of the heating body 30 is not limited, as long as it can generate heat after being energized, so as to heat the aerosol-forming substrate 20 to generate an aerosol. For example, in this embodiment, the material of the heating body 30 includes ceramic.

Specifically, in this embodiment, the aerosol-forming substrate 20 is rotatable to the second position along the circumferential direction in synchronization with the rotary portion 11. At the same time, in the second position, the aerosol-forming substrate 20 is rotatable along the circumferential direction in synchronization with the rotary portion 11. In other embodiments, in the second position, the aerosol-forming substrate may not rotate synchronously with the rotary portion along the circumferential direction, as long as the aerosol-forming substrate and the heating body are relatively movable in the circumferential direction. In this embodiment, the aerosol-forming substrate 20 is subjected to a radial pressing force in the second position.

The aerosol-forming substrate 20 and the heating body 30 are adhered together after the aerosol-forming substrate 20 is heated by the heating body 30, therefore under the radial pressing force, on one hand, an outer package of the aerosol-forming substrate 20 may be rotated along the circumferential direction in synchronization with the rotary portion 11 and the aerosol-forming substrate 20 is brought to move with respect to the heating body 30; and on the other hand, the aerosol-forming substrate 20 is not easily separated from the outer package. The aerosol-forming substrate 20 is not synchronously rotated while the outer package of the aerosol-forming substrate 20 is prevented from rotating synchronously with the rotary portion 11 along the circumferential direction. Therefore, the radial pressing force to which the aerosol-forming substrate 20 is subjected facilitates generating a relative movement of the aerosol-forming substrate 20 with respect to the heating body 30.

Meanwhile, the amount of the aerosol-forming substrate 20 remaining on the heating body 30 is less, which is more advantageous for the user to clean the aerosol generating device, when the aerosol-forming substrate 20 is pulled out from the heating body 30 along the axial direction after the aerosol-forming substrate 20 is rotated by a sufficient distance along the circumferential direction in synchronization with the rotary portion 11, that is, after the aerosol-forming substrate 20 is moved by a sufficient distance along the circumferential direction from the heating body 30, under the radial pressing force.

A pressing mechanism for applying the radial pressing force to the aerosol-forming substrate is disposed on the rotary portion. The pressing mechanism is a pressing elastic piece disposed to face the aerosol-forming substrate. The pressing elastic piece is deformed after being pressed so as to apply the radial pressing force to the aerosol-forming substrate. In one embodiment, the pressing elastic piece is disposed around the aerosol-forming substrate 20, and an outer surface of the rotary portion 11 at least partially comprises the pressing elastic piece. That is, a part of the outer surface of the rotary portion 11 is made from the pressing elastic piece.

In this embodiment, referring to FIG. 3 and as shown by combining with FIG. 1 and FIG. 2, at least one first through-hole 11*f* communicating with the accommodating chamber 11*a* of the rotary portion 11 is disposed on the rotary portion 11. The outer surface of the rotary portion 11 is provided with a pressing mechanism 13 extending in the axial direction (shown in an X direction in FIG. 1) which coincides with an inserting direction of the heating body 30. In other embodiments, the pressing mechanism 13 may not extend in the axial direction. A specific shape of the pressing mechanism 13 is not limited as long as the radial pressing force can be applied to the aerosol-forming substrate 20. In this embodiment, the pressing mechanism 13 has a sheet shape. The pressing mechanism 13 is connected to the rotary portion 11, and one end of the pressing mechanism 13 is inserted into the first through-hole 11*f* along the radial direction (shown in a Y direction in FIG. 1) to apply the radial pressing force to the aerosol-forming substrate 20.

When the user completes suctioning, before the aerosol-forming substrate 20 is pulled out, the pressing mechanism 13 is operable to be inserted into the first through-hole 11*f* along the radial direction so as to press the aerosol-forming substrate 20, and the pressing mechanism 13 clamps the aerosol-forming substrate 20 such that the aerosol-forming substrate 20 is subjected to the radial pressing force under the pressing mechanism 13. The rotary portion 11 is then gripped to be switched from the first position to the second position along the circumferential direction. The aerosol-forming substrate 20 is connected to contacted with the heating body 30. The aerosol-forming substrate 20 is rotated in synchronization with the rotary portion 11, and the aerosol-forming substrate 20 and the heating body 30 are relatively moved along the circumferential direction, such that the aerosol-forming substrate 20 is released from the heating body 30.

The releasing mechanism 10 of this embodiment further comprises a first case 12. The first case 12 is sleeved on the rotary portion 11, and is movable along the axial direction to press the pressing mechanism 13 into the first through-hole 11*f*. That is, in this embodiment, when the user completes suctioning, before the aerosol-forming substrate 20 is pulled out, the first case 12 is operable to move along the axial direction to press the pressing mechanism 13 into the first through-hole 11*f* so as to press the aerosol-forming substrate 20, and the aerosol-forming substrate 20 is subjected to the radial pressing force by the pressing mechanism 13. An axial movement direction of the first case 12 is not limited. The first case 12 may be axially moved along a direction which coincides with an inserting direction of the heating body 30, or may be axially moved along a direction that opposites to the inserting direction of the heating body 30, as long as the first case 12 can press the pressing mechanism 13 into the first through-hole 11*f* after the axial movement. In this embodiment, the direction of axial movement of the first case 12 is opposite to the inserting direction of the heating body 30.

It should be noted that, in the first position, the first case 12 is sleeved on the rotary portion 11 and is unable to be disengaged from the rotary portion 11 along the axial direction, and in the second position, the first case 12 is movable along the axial direction to press the pressing mechanism 13 into the first through-hole 11*f*. Specifically, the first case 12 can be connected to the rotary portion 11 in the axial direction by a spring (not shown.), and along the axial direction, one end of the spring is connected to the rotary portion 11 and the other end of the spring is connected to the first case 12. In other embodiments, other connection manners may be used as long as the following conditions are met: in the first position, the first case 12 is sleeved on the rotary portion 11 and is unable to be disengaged from the rotary portion 11 along the axial direction, and in the second position, the first case 12 is movable along the axial direction to press the pressing mechanism 13 into the first through-hole 11*f*.

Referring to FIG. 2, in this embodiment, the rotary portion 11 comprises an abutting surface. Along the axial direction, a portion between one end and other end of the pressing mechanism 13 is abutted against the abutting surface, and the other end of the pressing mechanism 13 is connected to the rotary portion 11 by an elastic element 14. Thus, during movement of the first case 12 along the axial direction to press the pressing mechanism 13, the pressing mechanism 13 can perform a lever movement with an intersection point, where the portion between the one end and the other end of the pressing mechanism 13 is abutted against the abutting surface of the rotary portion 11, as a fulcrum. The first case 12 is released after the rotary portion 11 is rotated by a certain distance along the circumferential direction, and then the first case 12 is returned back along the direction which coincides with the inserting direction of the heating body 30 under an elastic force of the elastic element 14. At the same time, the pressing mechanism 13 also can be returned back to be separated from the aerosol-forming substrate 20 along the radial direction such that the user can pull out the aerosol-forming substrate 20 at this time.

It should be noted that, a specific shape of the elastic element 14 is not limited, as long as the other end of the pressing mechanism 13 is elastically connected to the rotary portion 11 via the elastic element 14. In this embodiment, the pressing mechanism 13 is a plurality of pressing mechanisms. As shown in FIG. 3, four pressing mechanisms 13 are equally spaced apart along the circumferential direction, and the pressing mechanisms 13 also may be unequally spaced apart. Referring to FIG. 2 and FIG. 3, in this embodiment, the elastic element 14 is sleeved on the outer surface of the rotary portion 11 and clamps the other end of the pressing mechanism 13. The pressing mechanism 13 is provided with an accommodating groove 13*c* for accommodating the elastic element 14. A specific material of the elastic element 14 is not limited and may be a material such as elastic steel or highly elastic silicone. A material of the first case 12 is not limited and may be metal or plastic. The material of the pressing mechanism 13 may be high temperature resistant metal, ceramic or high molecular material.

Continuously referring to FIG. 2 and FIG. 3, the pressing mechanism 13 has a first convex portion 13*b* extending along the radial direction, and the first convex portion 13*b* is abutted against an inner wall of the first case 12 along the axial direction. An acting force is applied to the first convex portion 13*b* of the pressing mechanism 13 when the first case 12 moves along the axial direction, which is advantageous for inserting the pressing mechanism 13 into the first through-hole 11*f* along the radial direction to press the aerosol-forming substrate 20. In this embodiment, a portion of the first convex portion 13*b* facing the first case 12 has a first inclined surface 13*ba* and a second inclined surface 13*bc*. The first inclined surface 13*ba* is tightly engaged with the first case 12 along the axial direction, and the second inclined surface 13*bc* is tightly engaged with the first case 12 along the radial direction. Such design is advantageous for applying an acting force to the pressing mechanism 13 in the axial direction by the first case 12 so as to drive the pressing mechanism 13 to be inserted into the first through-hole 11*f* along the radial direction.

In addition, in this embodiment, referring to FIG. 2 and FIG. 3, the abutting surface of the rotary portion 11 is provided with a second convex portion 11*b*, and a portion between the one end and the other end of the pressing mechanism 13 is provided with a first concave portion 13*a* against which the second convex portion 11*b* is abutted. The second convex portion 11*b* serves as a fulcrum for a lever movement of the lever mechanism 13. In other embodiments, the abutting surface of the rotary portion 11 is provided with a first concave portion, and a portion between the one end and the other end of the pressing mechanism 13 is provided with a second convex portion which is abutted against the first concave portion. Or alternatively, in other embodiments, the pressing mechanism 13 can also perform a lever movement when one of the abutting surface of the rotary portion 11 and a portion between the one end and the other end of the pressing mechanism 13 is provided with a convex portion and the other is a smooth surface.

It should be noted that, this embodiment provides the radial pressing force to the aerosol-forming substrate 20 by operating the pressing mechanism 13. When the aerosol-forming substrate 20 is inserted into the accommodating chamber 11*a* of the rotary portion 11, that is, when the rotary portion 11 is in the first position, the pressing mechanism 13 will not provide the radial pressing force to the aerosol-forming substrate 20. It can be ensured that the process of inserting the aerosol-forming substrate 20 into the accommodating chamber 11*a* of the rotary portion is smooth and the resistance is small. When the rotary portion 11 is rotationally switched to the second position, the pressing mechanism 13 is further operated to provide the radial pressing force to the aerosol-forming substrate 20, so that the aerosol-forming substrate 20 can rotate synchronously with the rotary portion 11. It is advantageous for the relative movement of aerosol-forming substrate 20 with respect to the heating body 30 along the circumferential direction.

Second Embodiment

Figure 4:
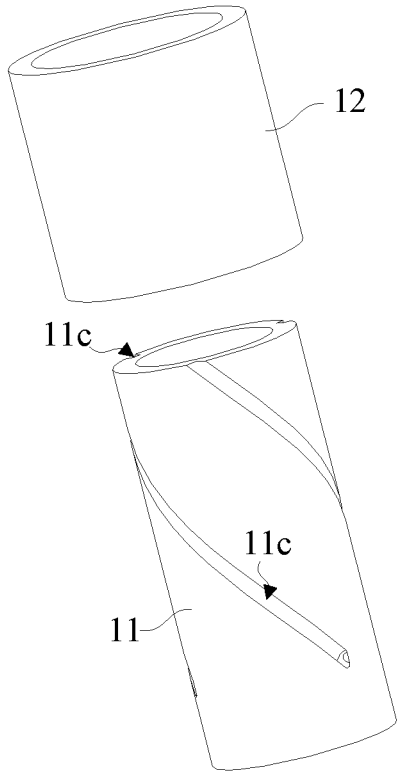
FIG. 4 is a second exploded perspective view of a releasing mechanism of an embodiment of present invention.
Figure 5:
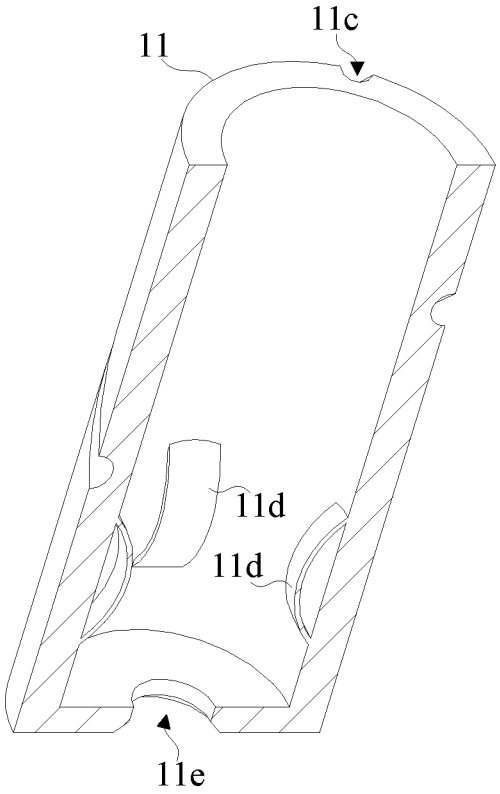
FIG. 5 is a cross-sectional view of a releasing mechanism of an embodiment of present invention.

Referring to FIG. 4 and FIG. 5, and as shown by combining with FIG. 1, in this embodiment, at least one convex portion 11*d* is disposed on a wall of the rotary portion 11 for applying a radial pressing force to the aerosol-forming substrate 20. The convex portion 11*d* will clamp the aerosol-forming substrate 20 when the aerosol-forming substrate 20 is inserted into the accommodating chamber 11*a* of the rotary portion 11, so that the aerosol-forming substrate 20 can rotate synchronously with the rotary portion 11. In this embodiment, the convex portion 11*d* is an elastic piece. When the aerosol-forming substrate 20 is inserted into the accommodating chamber 11*a* of the rotary portion 11, the elastic piece is pressed to move toward an chamber wall of the accommodating chamber 11*a* of the rotary portion 11 along an radial direction, so as to facilitate inserting the aerosol-forming substrate 20 into the accommodating chamber 11*a* of the rotary portion 11 smoothly. After the aerosol-forming substrate 20 is inserted into the heating body 30 and completely passes through the elastic piece, the elastic piece is returned back and applies the radial pressing force to the aerosol-forming substrate 20 so that the aerosol-forming substrate 20 can rotate synchronously with the rotary portion 11.

In this embodiment, the elastic piece extends along an axial direction. With such configuration, the elastic piece will be pressed to produce an inclined surface when the aerosol-forming substrate 20 is inserted into the accommodating chamber 11*a* of the rotary portion 11, and the presence of the inclined surface allows the aerosol-forming substrate 20 to be smoothly inserted into the accommodating chamber 11*a*. Meanwhile, the elastic piece also will be pressed to produce an inclined surface when the aerosol-forming substrate 20 is pulled out from the accommodating chamber 11*a*, and the presence of the inclined surface allows the aerosol-forming substrate 20 to be smoothly pulled out from the accommodating chamber 11*a*.

Further, the elastic piece has a first end and a second end which are respectively connected to the wall of the rotary portion 11, a portion between the first end and the second end is radially protruded outward along a direction from the first end to the second end, and a surface area of a top of the portion radially protruded outward is smaller than a surface area of the first end and a surface area of the second end respectively. That is, a contact area of the top of the portion of the elastic piece radially protruded outward with the aerosol-forming substrate 20 is smaller. Therefore, the radial pressing force between the top of the portion of the elastic piece radially protruded outward and the aerosol-forming substrate 20 can be increased, and the aerosol-forming substrate 20 can be clamped better by the top of the portion of the elastic piece radially protruded outward, which is advantageous for releasing the aerosol-forming substrate 20 from the heating body 30.

Figure 6:
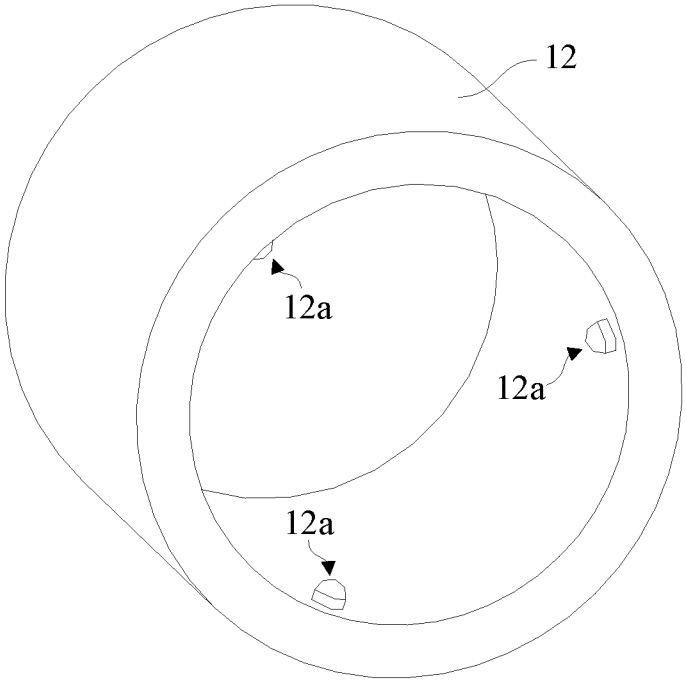
FIG. 6 is a perspective view of a first case of a releasing mechanism of an embodiment of present invention.

In addition, the releasing mechanism 10 of this embodiment further comprises a first case 12 which is sleeved on the rotary portion 11 and is movable along the axial direction, which coincides with the inserting direction of the heating body 30, to drive the rotary portion 11 to rotate along the circumferential direction. A specific implementation of the first case 12 to drive the rotary portion 11 to move along the circumferential direction is not limited. In this embodiment, referring to FIG. 6 and as shown by combining with FIG. 4, an outer surface of the rotary portion 11 is provided with three spiral grooves 11*c* extending along the axial direction, and three third convex portions 12*a* are disposed within a case wall of the first case 12. The third convex portions 12*a* are disposed in the spiral grooves 11*c* and are slidable within the spiral grooves 11*c*.

In other embodiments, an outer surface of the rotary portion is provided with at least one spiral groove extending along the axial direction, and at least one third convex portion is disposed within a case wall of the first case; or alternatively the outer surface of the rotary portion is provided with the at least one third convex portion, and an inner surface of the case wall of the first case is provided with the at least one spiral groove extending along the axial direction; the third convex portion is disposed in the spiral groove and is slidable within the spiral groove.

In this embodiment, by controlling the movement of the first housing 12 along the axial direction, the third convex portion 12*a* will be slid within the spiral groove 11*c*, and then the rotary portion 11 is driven to rotate along the circumferential direction, so that the rotary portion 11 is switched from the first position to the second position. In this embodiment, the third convex portion 12*a* is a plurality of third convex portions spaced apart along the same circumferential direction, which is more advantageous for driving the rotary portion 11 to rotate along the circumferential direction. In other embodiments, third convex portions may not be spaced apart along the same circumferential direction, as long as the third convex portions slide within the spiral grooves to drive the rotary portion to rotate along the circumferential direction during movement of the first case along the axial direction.

That is, the rotary portion 11 is in the first position and the rotary portion 11 is subjected to the radial pressing force while the aerosol-forming substrate 20 is inserted into the accommodating chamber 11*a* of the rotary portion 11. In other embodiments, the rotary portion 11 may not be subjected to the radial pressing force when the rotary portion 11 is in the first position, which is advantageous for smoothly inserting the aerosol-forming substrate 20 into the heating body 30. The aerosol-forming substrate 20 is subjected to the radial pressing force while the rotary portion 11 is switched from the first position to the second position. That is, the radial pressing force, to which the rotary portion 11 is subjected, is generated by a circumferential movement of the rotary portion 11.

Third Embodiment

Figure 7:
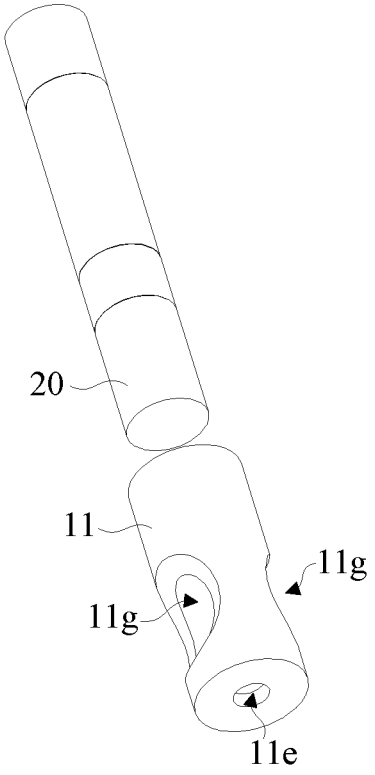
FIG. 7 is a first perspective view of a releasing mechanism and an aerosol-forming substrate of an embodiment of present invention.

Referring to FIG. 7, and as shown by combining with FIG. 1, in this embodiment, a portion of the rotary portion 11 adjacent to the heating body 30 is provided with at least one second through-hole 11*g* communicating with the accommodating chamber 11*a* of the rotary portion 11, and the aerosol-forming substrate 20 is exposed by the second through-hole 11*g*. In this embodiment, two second through-holes 11*g* communicating with the accommodating chamber 11*a* of the rotary portion 11 are disposed on the rotary portion 11. After the user completes suctioning, the aerosol-forming substrate 20 is pinched and clamped at the second through-hole 11*g* by a user's fingers. The aerosol-forming substrate 20 is rotated in synchronization with the rotary portion 11 by the radial pressing force applied by the fingers, and the rotary portion 11 is switched from the first position to the second position. After rotating by a certain distance, the fingers leave the second through-hole 11*g* and pull out the aerosol-forming substrate 20 from the accommodating chamber 11*a* of the rotary portion 11.

In this embodiment, no convex portion is provided when the aerosol-forming substrate 20 is inserted into the accommodating chamber 11*a* of the rotary portion 11, that is, when the rotary portion 11 is in the first position. The process of inserting the aerosol-forming substrate 20 into the accommodating chamber 11*a* of the rotary portion 11 is smooth, and the resistance is small.

Further, in this embodiment, a pressing mechanism is disposed at the second through-hole for applying the radial pressing force to the aerosol-forming substrate 20 along the radial direction. A specific shape and arrangement of the pressing mechanism can be referred to the description of the first embodiment, and the details are not described herein again.

Fourth Embodiment

Figure 8:
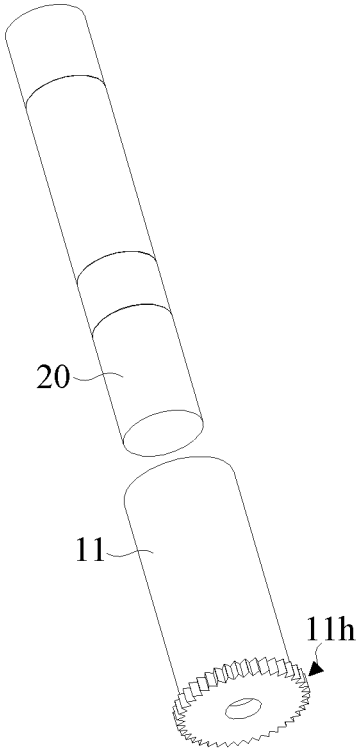
FIG. 8 is a second perspective view of a releasing mechanism and an aerosol-forming substrate of an embodiment of present invention.

Referring to FIG. 8, in this embodiment, an outer surface of the rotary portion 11 is provided with a gear 11*h* extending along the circumferential direction, and a power source is disposed on the releasing mechanism 10 for driving the gear 11*h* to rotate along the circumferential direction. For example, the gear 11*h* may be driven to be rotated along the circumferential direction by an electric motor or a gear-rack drive, and then the rotary portion 11 is driven to be switched from the first position to the second position. As shown by combining with FIG. 5, a chamber wall of the accommodating chamber 11*a* of the rotary portion 11 is also provided with at least one convex portion 11*d* for applying a radial pressing force to the aerosol-forming substrate 20. The arrangement and working principle of the convex portion 11*d* can be referred to the description of the second embodiment, and the details are not described herein again.

Fifth Embodiment

Figure 9:
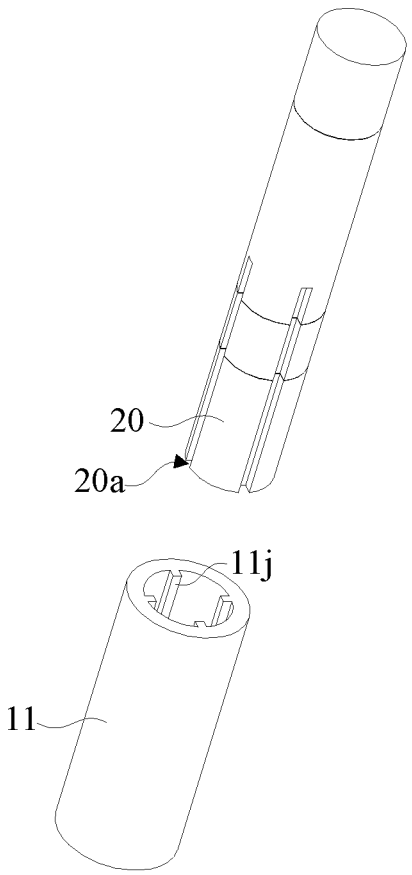
FIG. 9 is a third perspective view of a releasing mechanism and an aerosol-forming substrate of an embodiment of present invention.

Referring to FIG. 9, and as shown by combining with FIG. 1, in this embodiment, the movement of the aerosol-forming substrate 20 in the circumferential direction is restricted after the aerosol-forming substrate 20 is placed on the rotary portion 11 along an axial direction, which coincides with an extending direction of the heating body 30. Specifically, an inner wall of the accommodating chamber 11*a* of the rotary portion 11 is provided with at least one fourth convex portion 11*j* extending along the axial direction, which coincides with the extending direction of the heating body 30. Four fourth convex portion 11*j* spaced apart along the circumferential direction are shown. In other embodiments, other numbers of the fourth convex portion 11*j* may be selected. In addition, the outer surface of the aerosol-forming substrate 20 is provided with at least one concave portion 20*a* extending along the axial direction. The fourth convex portion 11*j* is inserted into the second concave portion 20*a* along the axial direction. The aerosol-forming substrate 20 can also rotate along the circumferential direction in synchronization with the rotary portion 11 when the rotary portion 11 is rotationally switched from the first position to the second position.

In other embodiments, it is possible that the inner wall of the accommodating chamber of the rotary portion is provided with at least one second concave portion extending along the axial direction, which coincides with the extending direction of the heating body. The outer surface of the aerosol-forming substrate is provided with at least one fourth convex portion extending along the axial direction, and the fourth convex portion is inserted in the second concave portion along the axial direction.

It should be noted that, in other embodiments, the second concave portion and the fourth convex portion may not extend along the axial direction, as long as the movement of aerosol-forming substrate along the circumferential direction can be restricted after the aerosol-forming substrate is placed on the rotary portion along the axial direction. For example, the inner wall of the accommodating chamber of the rotary portion is provided with the second concave portion, and the outer surface of the aerosol-forming substrate is provided with the fourth convex portion. After the aerosol-forming substrate is inserted into the rotary portion along the axial direction and rotated by a certain angle along the circumferential direction, the fourth convex portion and the second concave portion are engaged, and the movement of the aerosol-forming substrate along the circumferential direction is restricted after being placed on the rotary portion along the axial direction.

In this embodiment, no convex portion is provided when the aerosol-forming substrate 20 is inserted into the accommodating chamber 11*a* of the rotary portion 11, that is, when the rotary portion 11 is in the first position. The process of inserting the aerosol-forming substrate 20 into the accommodating chamber 11*a* of the rotary portion 11 is smooth, and the resistance is small.

It should be noted that, when the convex portion disposed on the inner chamber wall of the accommodating chamber 11*a* of the rotary portion 11 is an elastic piece, the elastic piece is provided with a deformation sensor for detecting the aerosol-forming substrate 20 inserted into the accommodating chamber 11*a* in accordance with the deformation of the elastic piece. It is possible to prevent a minor from operating the heating body 30 by mistake after the deformation sensor is provided. The heating body 30 is heated only when the aerosol-forming substrate 20 is inserted into the accommodating chamber 11*a* of the rotary portion. Thus, a protective effect is achieved.

In addition, referring to FIG. 5 and FIG. 7, the rotary portion 11 is provided with a hole 11*e* through which the heating body 30 is inserted, and the hole 11*e* has an aperture which is not smaller than an outer diameter of the heating body 30. When the aperture of the hole 11*e* is larger than the outer diameter of the heating body 30, after the releasing mechanism 10 of the above embodiment is rotationally connected to the aerosol generating device, the heating body 30 heats the aerosol-forming substrate 20 to generate an aerosol and then the inside of the accommodating chamber 11*a* of the rotary portion communicates with the outside atmosphere through the hole 11*e* so that the user can suction the aerosol generated by the aerosol-forming substrate 20.

In other embodiments, corresponding air passages may be provided in other portions of the releasing mechanism to enable the user to smoothly suction the aerosol generated by the aerosol-forming substrate 20. For example, an opening may be disposed at the convex portion 11*d* as shown in FIG. 5, and a through-hole 11*g* may be disposed on the releasing mechanism as shown in FIG. 7. Both the opening and the through-hole 11*g* may be in communication with the outside atmosphere. In this case, the aperture of the opening-hole 11*e* can be made as equivalent as possible to the outer diameter of the heating body 30 in size, in order to prevent debris from falling into a gap formed between a support portion of the heating body 30 and an end of the rotary portion 11 which affects the apparatus performance, when the aerosol generating substrate 20 is removed.

Sixth Embodiment

Figure 10:
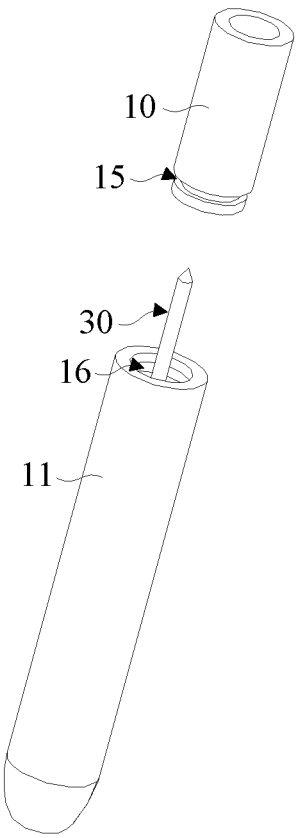
FIG. 10 is a schematic view of an installation of a releasing mechanism to an aerosol generating device of an embodiment of present invention.

Referring to FIG. 10, and as shown by combining with FIG. 1, this embodiment provides an aerosol generating device, comprising: the heating body 30; and the releasing mechanism 10 of any one of the above embodiments. The rotary portion 11 is connected to the aerosol generating device rotatably between the first position and the second position, and is limited to the aerosol generating device along the axial direction. The heating body 30 is inserted into the accommodating chamber 11*a* of the rotary portion 11. The aerosol generating device further comprises a body portion 40 on which the heating body 30 is disposed via a heating body holder 31. The rotary portion 11 is disposed on the body portion 40, connected with the body portion 40 rotatably in the circumferential direction, and has no relative movement in the axial direction with the body portion 40.

With such design, during switching of the rotary portion 11 from the first position to the second position, the rotary portion 11 rotates along the circumferential direction, and the body portion 40 remains stationary; or alternatively, the body portion 40 rotates along the circumferential direction and the heating body 30 rotates synchronously with the body portion 40 while the rotary portion 11 remains stationary. Both cases can achieve a relative movement of the aerosol-forming substrate 20 with respect to the heating body 30 in the circumferential direction (shown in the Z direction in FIG. 1).

In other embodiments, the rotary portion disposed on the body portion is connected to the heating body rotatably in the circumferential direction, such as with the heating body holder 31, and has no relative movement in the axial direction with the heating body. With such design, during switching of the rotary portion 11 from the first position to the second position, the rotary portion 11 rotates along the circumferential direction, and the heating body 30 remains stationary; or alternatively, the heating body 30 rotates along the circumferential direction and the body portion does not rotate synchronously with the heating body while the rotary portion 11 remains stationary. Both cases can achieve a relative movement of the aerosol-forming substrate 20 with respect to the heating body 30 in the circumferential direction (shown in the Z direction in FIG. 1).

Figure 11:
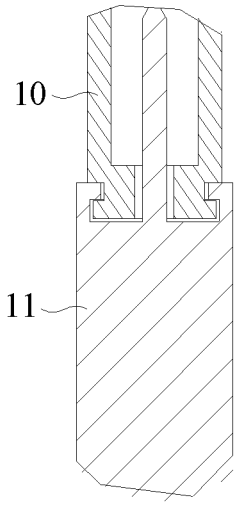
FIG. 11 is a sectional view at a connection between a releasing mechanism and an aerosol generating device of an embodiment of present invention.

Specifically, referring to FIG. 10, a first slot 15 is disposed on the releasing mechanism 10, and a second slot 16 is disposed on the body portion 40. As shown by combining with FIG. 11, the first slot 15 and the second slot 16 are engaged to engage the rotary portion 11 to the body portion 40. In other embodiments, the rotary portion 11 and the body portion 40 may be engaged in other forms, as long as the rotary portion 11 is engaged to the body portion 40.

Referring again to FIG. 1, a control circuit 41, an indicator light 45, a button 44, a battery 42, and a charging control circuit 43 are also disposed on the body portion 40. The heating body 30 is connected to the control circuit 41 connected to the battery 42, and the charging control circuit 43 is connected to the battery 42 and the control circuit 41. Start and stop of the heating body 30 can be controlled by pressing the button 44. The indicator light 45 on the button 44 can indicate an operating status of the aerosol generating device. The control circuit 41 and the heating body 30 cooperate to control the temperature of the heating body 30 between 200 degrees Centigrade and 500 degrees Centigrade, which ensures that the heated aerosol-forming substrate 20 can volatilize a stable aerosol. The charging control circuit 43 can perform a control for charging the battery 42.

When the user suctions the aerosol by the aerosol generating device of the present embodiment, the aerosol-forming substrate 20 is inserted into the accommodating chamber 11*a* of the rotary portion 11, and the heating body 30 is inserted into the aerosol-forming substrate 20. At this time, the rotary portion 11 is in the first position, the aerosol-forming substrate 20 is in contact with the heating body 30, and both remain relatively stationary. The heating body 30 is controlled to heat the aerosol-forming substrate 20 to generate the aerosol for the user to suction. When the user completes suctioning, the rotary portion 11 is controlled to be rotationally switched from the first position to the second position along the circumferential direction before the aerosol-forming substrate 20 is pulled out. When the rotary portion 11 is in the second position, the aerosol-forming substrate 20 is connected to and contacted with the heating body 30, and the aerosol-forming substrate 20 and the heating body 30 are relatively moved in the circumferential direction.

The aerosol-forming substrate 20 changes from being adhered to the heating body 30 to being released from the heating body 30 during the relative movement in circumferential direction between the aerosol-forming substrate 20 and the heating body 20. The aerosol-forming substrate 20 can be easily pulled out from the heating body 30 by the user, and it is convenient to use and also convenient for the user to clean the aerosol generating device.

Further, the surface of the heating body 30 is provided with a glaze layer in order to make the relative movement of the heating body 30 with the aerosol-forming substrate 20 in the circumferential direction smoother. After the glaze layer is disposed, the resistance suffered when the heating body 30 and the aerosol-forming substrate 20 are relatively moved in the circumferential direction is smaller, which is advantageous for releasing the aerosol-forming substrate 20 from the heating body 30.

Seventh Embodiment

As shown by combining with FIG. 1, the present invention provides a method of releasing the aerosol-forming substrate 20, comprising: causing the aerosol-forming substrate 20 being rotatable from the first position to the second position along the circumferential direction with respect to the heating body 30 after the heating body 30 of an aerosol generating device is inserted into the aerosol-forming substrate 20, wherein the aerosol-forming substrate 20 and the heating body 30 are relatively movable in the circumferential direction during switching from the first position to the second position. In the first position, the aerosol-forming substrate 20 is connected to and contacted with the heating body 30 and has a first axial position with respect to the heating body 30; in the second position, the aerosol-forming substrate is connected to and contacted with the heating body 30 and has a second axial position with respect to the heating body 30, and the aerosol-forming substrate 20 and the heating body 30 are relatively moved in the circumferential direction. The first axial position is the same as the second axial position. The aerosol-forming substrate 20 being adhered to the heating body 30 is released from the heating body 30 during the relative movement in circumferential direction between the aerosol-forming substrate 20 and the heating body 30. The aerosol-forming substrate 20 can be easily removed from the heating body 30 by the user, and it is convenient to use.

Preferably, this embodiment uses the releasing mechanism described in any one of the above embodiments to release the aerosol-forming substrate 20. The aerosol-forming substrate 20 can be synchronously rotated to the second position along the circumferential direction with the rotary portion 11, so that the aerosol-forming substrate 20 can rapidly come into being relatively moved in the circumferential direction with respect to the heating body 30 to release. In other embodiments, the aerosol-forming substrate 20 is subjected to the radial pressing force in the second position during releasing of the aerosol-forming substrate 20. It is advantageous for the aerosol-forming substrate 20 to move relatively with the heating body 30, that is, it is advantageous for releasing the aerosol-forming substrate 20 as the aerosol-forming substrate 20 is subjected to a radial pressing force.

In other embodiment, the first axial position is not the same as the second axial position, and during rotation of the rotary portion 11 with respect to the aerosol generating device, the aerosol-forming substrate 20 is in contact with the heating body 30, and the heating body 30 and the aerosol-forming substrate 20 are not only moved in the circumferential direction but also moved in the axial direction; as long as the aerosol-forming substrate 20 and the heating body 30 are relatively movable in the circumferential direction and the aerosol-forming substrate 20 is in contact with the heating body 30 during switching from the first position to the second position.

In other embodiments, during releasing of the aerosol-forming substrate 20, the aerosol-forming substrate 20 is subjected to the radial pressing force while the rotary portion 11 is switched from the first position to the second position. That is, in the first position, the rotary portion 11 is not subjected to the radial pressing force, which is advantageous for smoothly inserting the aerosol-forming substrate 20 into the heating body 30. The aerosol-forming substrate 20 is subjected to the radial pressing force while the rotary portion 11 is switched from the first position to the second position. Under the radial pressing force, the aerosol-forming substrate 20 and the heating body 30 are caused to move relative to each other, and the aerosol-forming substrate 20 can be smoothly removed.

Referring to FIG. 9, the present invention also provides a smoking producing article comprising the aerosol-forming substrate 20 which is usable to the above releasing mechanism. The movement of the aerosol-forming substrate 20 in the circumferential direction is restricted after the aerosol-forming substrate 20 is placed on the rotary portion 11 of the releasing mechanism along an axial direction, which coincides with the extending direction of the heating body 30. The outer surface of the aerosol-forming substrate is provided with the fourth convex portion or the second concave portion 20*a*. Further descriptions of the aerosol-forming substrate 20 can be referred to the fifth embodiment, and the details are not described herein again.

After the aerosol-forming substrate 20 of the smoking producing article is inserted into the rotary portion 11 of the releasing mechanism along the axial direction by the fourth convex portion or the second concave portion 20*a*, the aerosol-forming substrate 20 is also rotatable in synchronization with the rotary portion 11 in the circumferential direction when the rotary portion 11 is rotationally switched from the first position to the second position.

In conclusion, the above-described embodiments of the present invention are merely illustrative of the principles and effects of the present invention, and are not intended to limit the present invention. Modifications or variations of the above-described embodiments may be made by those skilled in the art without departing from the spirit and scope of the invention. Therefore, all equivalent modifications or changes made by those skilled in the art without departing from the spirit and scope of the invention will be covered by the appended claims.

The invention claimed is:

1. A releasing mechanism for an aerosol generating device provided with a heating body, wherein the heating body is insertable into an aerosol-forming substrate placed on the releasing mechanism, the releasing mechanism comprising:

a rotary portion rotatably connected to the aerosol generating device between a first position and a second position, wherein the aerosol-forming substrate and the heating body are relatively movable in a circumferential direction during switching from the first position to the second position, and wherein both in the first position and in the second position, the aerosol-forming substrate is in contact with the heating body.

2. The releasing mechanism of claim 1, wherein the aerosol-forming substrate has a first axial position with respect to the heating body in the first position; the aerosol-forming substrate has a second axial position with respect to the heating body in the second position, and the first axial position is the same as the second axial position.

3. The releasing mechanism of claim 1, wherein the aerosol-forming substrate is rotatable to the second position along the circumferential direction in synchronization with the rotary portion.

4. The releasing mechanism of claim 3, wherein a pressing mechanism for applying a radial pressing force to the aerosol-forming substrate is disposed on the rotary portion.

5. The releasing mechanism of claim 4, wherein the pressing mechanism is a pressing elastic piece disposed to face the aerosol-forming substrate.

6. The releasing mechanism of claim 5, wherein the pressing elastic piece is disposed around the aerosol-forming substrate, and an outer surface of the rotary portion at least partially comprises the pressing elastic piece.

7. The releasing mechanism of claim 4, wherein at least one first through-hole communicating with the rotary portion is disposed on the rotary portion, and wherein the pressing mechanism is connected to the rotary portion, and one end of the pressing mechanism is used to be inserted into the first through-hole along a radial direction to apply the radial pressing force to the aerosol-forming substrate.

8. The releasing mechanism of claim 7, wherein the pressing mechanism extends along an axial direction, which coincides with an inserting direction of the heating body.

9. The releasing mechanism of claim 8, further comprising a first case, which is sleeved on the rotary portion and is movable along the axial direction to press the pressing mechanism into the first through-hole.

10. The releasing mechanism of claim 9, wherein the pressing mechanism has a convex portion extending along the radial direction, and the convex portion is abutted against an inner wall of the first case along the axial direction.

11. The releasing mechanism of claim 7, wherein the rotary portion comprises an abutting surface, and wherein a portion between the one end and other end of the pressing mechanism is abutted against the abutting surface, and the other end of the pressing mechanism is connected to the rotary portion by an elastic element.

12. The releasing mechanism of claim 11, wherein the elastic element is sleeved on an outer surface of the rotary portion and clamps the other end of the pressing mechanism.

13. The releasing mechanism of claim 11, wherein the abutting surface is provided with a convex portion, and the portion between the one end and the other end of the pressing mechanism is provided with a first concave portion against which the convex portion is abutted, or alternatively the abutting surface is provided with a first concave portion, and the portion between the one end and the other end of the pressing mechanism is provided with a second convex portion which is abutted against the first concave portion.

14. The releasing mechanism of claim 3, wherein at least one convex portion for applying a radial pressing force to the aerosol-forming substrate is disposed on a wall of the rotary portion.

15. The releasing mechanism of claim 14, wherein the convex portion is an elastic piece.

16. The releasing mechanism of claim 15, wherein the elastic piece has a first end and a second end which are respectively connected to the wall of the rotary portion, a portion between the first end and the second end is radially protruded outward along a direction from the first end to the second end, and a surface area of a top of the portion radially protruded outward is smaller than each of a surface area of the first end and a surface area of the second end.

17. The releasing mechanism of claim 15, wherein the elastic piece detects whether the aerosol-forming substrate is placed on the rotary portion according to a deformation of the elastic piece.

18. The releasing mechanism of claim 14, further comprising a first case which is sleeved on the rotary portion and is movable along an axial direction, which coincides with an inserting direction of the heating body, to drive the rotary portion to rotate along the circumferential direction.

19. The releasing mechanism of claim 18, wherein an outer surface of the rotary portion is provided with at least one spiral groove extending along the axial direction, and at least one other convex portion is disposed within a case wall of the first case, or alternatively the outer surface of the rotary portion is provided with the at least one other convex portion, and an inner surface of the case wall of the first case is provided with at least one spiral groove extending along the axial direction, the at least one other convex portion is disposed in the spiral groove and is slidable within the spiral groove.

20. The releasing mechanism of claim 14, wherein an outer surface of the rotary portion is provided with a gear extending along the circumferential direction, and a power source is disposed on the releasing mechanism.

21. The releasing mechanism of claim 3, wherein a portion of the rotary portion adjacent to the heating body is provided with at least one through-hole communicating with the rotary portion, and the aerosol-forming substrate is exposed by the through-hole.

22. The releasing mechanism of claim 21, wherein a pressing mechanism is disposed on an outer surface of the rotary portion for applying a radial pressing force to the aerosol-forming substrate along a radial direction is disposed at the through-hole.

23. The releasing mechanism of claim 3, wherein a movement of the aerosol-forming substrate in the circumferential direction is restricted after the aerosol-forming substrate is placed on the rotary portion along an axial direction which coincides with an extending direction of the heating body.

24. The releasing mechanism of claim 23, wherein an inner wall of the rotary portion is provided with at least one second concave portion, an outer surface of the aerosol-forming substrate is provided with at least one convex portion, and the at least one convex portion is used to be inserted into the second concave portion along the axial direction; or alternatively wherein the inner wall of the rotary portion is provided with the at least one convex portion, the outer surface of the aerosol-forming substrate is provided with at least one second concave portion, and the at least one convex portion is used to be inserted into the second concave portion along the axial direction.

25. A smoking producing article comprising an aerosol-forming substrate which is usable to the releasing mechanism of claim 24, wherein an outer surface of the aerosol-forming substrate is provided with the at least one convex portion or a second concave portion.

26. The releasing mechanism of claim 1, wherein the rotary portion is provided with a hole for the heating body to be inserted through, and the hole has an aperture which is not smaller than an outer diameter of the heating body.

27. An aerosol generating device, comprising:

a heating body; and a releasing mechanism, wherein the heating body is insertable into an aerosol-forming substrate placed on the releasing mechanism, wherein the releasing mechanism comprises a rotary portion rotatably connected to the aerosol generating device between a first position and a second position, wherein the aerosol-forming substrate and the heating body are relatively movable in a circumferential direction during switching from the first position to the second position, and wherein both in the first position and in the second position, the aerosol-forming substrate is in contact with the heating body.

28. A method of releasing an aerosol-forming substrate, comprising:

causing the aerosol-forming substrate to be rotatable from a first position to a second position along a circumferential direction with respect to a heating body of an aerosol generating device after the heating body is inserted into the aerosol-forming substrate, wherein the aerosol-forming substrate and the heating body are relatively movable in the circumferential direction during switching from the first position to the second position;

wherein both in the first position and in the second position, the aerosol-forming substrate is in contact with the heating body.

29. The method of claim 28, wherein the aerosol-forming substrate has a first axial position with respect to the heating body in the first position; the aerosol-forming substrate has a second axial position with respect to the heating body in the second position, and the first axial position is the same as the second axial position.

30. The method of claim 28, wherein the aerosol-forming substrate is rotatable to the second position along the circumferential direction in synchronization with a rotary portion of a releasing mechanism for the aerosol generating device provided with the heating body, wherein the heating body used to be inserted into the aerosol-forming substrate placed on the releasing mechanism, the releasing mechanism comprising the rotary portion rotatably connected to the aerosol generating device between a first position and a second position, wherein the aerosol-forming substrate and the heating body are relatively movable in a circumferential direction during switching from the first position to the second position; wherein both in the first position and in the second position, the aerosol-forming substrate is in contact with the heating body.

* * * * *